US005477753A

United States Patent [19]

Branscum et al.

[11] Patent Number: 5,477,753

[45] Date of Patent: Dec. 26, 1995

[54] BLADE SHARPENING DEVICE

[75] Inventors: Tony E. Branscum, Winfield, Kans.; Terry L. Butler, Neosho, Mo.

[73] Assignee: Lohman Mfg. Co., Inc., Neosho, Mo.

[21] Appl. No.: 380,599

[22] Filed: Jan. 30, 1995

[51] Int. Cl.[6] ..... B24B 3/54

[52] U.S. Cl. ..... 76/82; 451/552; 451/555

[58] Field of Search ..... 76/82, 84, 86; 451/552, 555, 557, 558, 540

[56] References Cited

U.S. PATENT DOCUMENTS

| | | | |
|---|---|---|---|
| 253,634 | 2/1882 | Shinn | 76/84 |
| 4,231,194 | 11/1980 | Glesser | 451/552 |
| 4,450,653 | 5/1984 | Fletcher | 451/552 |
| 4,719,722 | 1/1988 | Washburn | 76/86 |

OTHER PUBLICATIONS

Ceramic Sharpening Systems models CS–1005 and CS–1125, Lohman Catalog, p. 3, 1995.

*Primary Examiner*—Hwei-Siu Payer

*Attorney, Agent, or Firm*—Shook, Hardy & Bacon

[57] ABSTRACT

A blade sharpening device is convertible between a sharpening configuration and a storage configuration. The device has an elongated body with a lower surface for resting on a support surface and an upper surface with a pair of receiving holes disposed thereon. Each of the receiving holes receives one elongated abrasive sharpening member so that the members can be supported in a V-shaped sharpening pattern when the device is in its sharpening configuration. The body also has a pair of elongated storage chambers extending along the longitudinal length of the body. Each of the storage chambers has an opening disposed on one end of the body. Each of the storage chambers receives one of the sharpening members through its respective opening when the device is in its storage configuration. A cover is pivotally secured to the body at an intermediate location and has an open position corresponding to the sharpening configuration and a closed position corresponding to the storage configuration. The cover, when in its closed position, encloses each of the openings of the chambers so that each of the sharpening members is secured in its respective storage chamber. The cover, when in its open position, allows positioning of the sharpening members in the receiving holes to form the V-shaped sharpening pattern.

4 Claims, 1 Drawing Sheet

BLADE SHARPENING DEVICE

This invention relates to a device for sharpening knife blades or the like and, more particularly, to a sharpening device that utilizes abrasive elongated members disposed in a V-shaped pattern.

One typical type of knife sharpening device consists of a pair of abrasive cylindrical rods supported on an elongated body in a V-shaped pattern. The V-shaped pattern of the rods is positioned adjacent one side of the elongated body. The other end of the body is grasped by one hand of the device user. While positioning the body on a support surface and grasping it with one hand, the user holds a knife or other cutting instrument in his or her other hand and utilizes the abrasive rods to sharpen the blade.

The knife is held horizontally, with the blade in a vertical plane. The knife is moved downwardly and horizontally so that one side of the edge of the blade engages one of the sharpening rods. After the blade has been moved downwardly and horizontally along one of the rods, the user positions the blade so that the other side of the edge is adjacent the other rod and a similar motion is repeated with the other side of the edge engaging the other rod. By alternating back and forth between the rods, both sides of the edge can be uniformly sharpened. Further, because each of the rods is positioned at an angle with respect to a vertical plane and the blade is moved generally parallel to that vertical plane during sharpening, a uniformly angled edge is applied to the blade.

In device constructions where the sharpening rods are permanently positioned and attached to the elongated body, the device is cumbersome and difficult to store and handle. In other device constructions wherein the sharpening rods are removable from the body, the sharpening rods are oftentimes misplaced when not in their sharpening positions. Further, when the rods are not in their sharpening positions, the storage of three separate parts (the body and the two rods) is required.

An additional disadvantage associated with this type of sharpening device involves possible injury of the user. More particularly, the user is required to brace the body of the device on the support surface with one hand and freely position and move the knife with the other hand during sharpening. Oftentimes users are not adept to moving the knife in its sharpening motion. Therefore, the hand of the user grasping the body can sometimes enter the path of the blade through inadvertence, resulting in laceration of the hand.

As is apparent., a knife-sharpening device is needed which effectively stores the sharpening rods inside an elongated body so that the sharpening device comprises an easily storable single unit. Further, for the safety of the user, a guard is needed which will protect the user from inadvertent lacerations of the hand used to grasp the device.

Accordingly, it is a primary object of the present invention to provide a blade sharpening device which is convertible between a sharpening configuration where the abrasive rods are positioned to allow sharpening and a storage configuration where the abrasive rods are secured within the device to allow easy handling and storage of the device.

Another important object is to provide a blade sharping device which protects and shields the hand of the user during sharpening.

These and other important aims and objects of the present invention will be further described, or will become apparent from the following description and explanation of the drawings, wherein.

Figures 1, 2, 3, 4, 5:
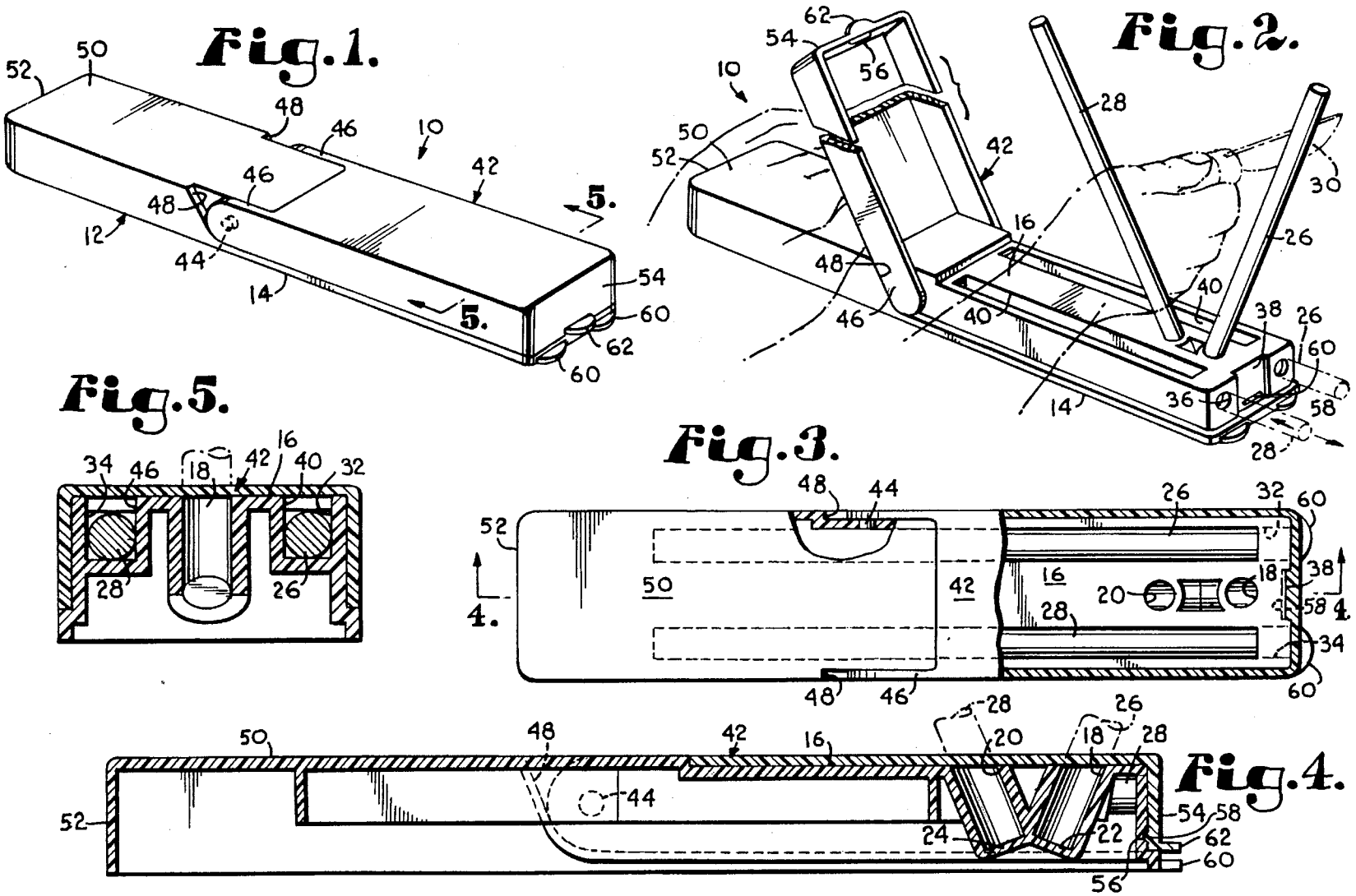
FIG. 1 is a top perspective view of a blade-sharpening device embodying the principles of this invention and showing the device in its storage configuration wherein the device cover is in its closed position.
FIG. 2 is a top perspective view similar to FIG. 1 showing the sharpening device in its sharpening configuration with the cover in its open position and the sharpening rods disposed in their V-shaped sharpening pattern.
FIG. 3 is a top plan view of the blade-sharpening device of FIG. 1 with the sharpening rods in their stowed positions, parts being broken away and shown in cross section to reveal details of construction.
FIG. 4 is a detailed cross-sectional view taken generally along line 4—4 of FIG. 3.
FIG. 5 is a detailed cross-sectional view taken generally along line 5—5 of FIG. 1.

A blade sharpening device embodying the principles of this invention is broadly designated in the figures by the reference numeral 10. Device 10 has elongated body 12 preferably formed of a suitable plastic. Body 12 has lower surface 14 which engages the supporting surface on which the device rests. Body 12 also has upper surface 16. A pair of generally cylindrical receiving holes 18 and 20 are formed in body 12 so that they open to upper surface 16 as best shown in FIGS. 3 and 4. The lower ends of holes 18 and 20 are closed off by bottom portions 22 and 24, respectively. Holes 18 and 20 are aligned in a V-shaped orientation so that bottom portions 22 and 24 generally abut one another.

When the sharpening device is in its sharpening configuration, as shown in FIG. 2, elongated abrasive metal sharpening rods 26 and 28 are positioned with their lower ends received in holes 18 and 20, respectively. Although rods 26 and 28 are depicted in the figures as having a cylindrical shape, they can also have any other suitable elongated shape. For example, the rods can have a generally rectangular cross section. Rods 26 and 28 can also be made of any suitable abrasive material, for example, a ceramic material or a diamond-coated material. Because of the V-shaped orientation of holes 18 and 20, rods 26 and 28 form a V-shaped sharpening pattern shown in FIG. 2. The V-shaped pattern of rods 26 and 28 allows the cutting edge of a blade to be uniformly sharpened at the proper angle. That is, as shown in FIG. 2, a device user positions blade 30 so that the blade generally lies in a vertical plane that is perpendicular to the longitudinal sides of body 12. The user then moves the blade downwardly maintaining this orientation so that one side of the edge of the blade engages rod 26. As the blade is moved downwardly, the user also moves the blade horizontally so that the entire length of the edge contacts the rod. After making this downward pass with the blade engaging rod 26, the user then performs the same operation with the opposite side of the edge engaging rod 28. By going back and forth between rods 26 and 28, the user can ensure that each of the sides of the cutting edge is uniformly sharpened.

Body 12 also has elongated rod storage chambers 32 and 34 formed therein, as best shown in FIGS. 3 and 5. Chambers 32 and 34 extend generally along the length of body 12. Each of chambers 32 and 34 has an opening 36 formed on end 38 of body 12 as best shown in FIG. 2. The other ends of chambers 32 and 34 are closed off. Thus, rods 26 and 28 can be positioned in chambers 32 and 34, respectively, simply by sliding the rods through openings 36, as best shown in FIG. 2 in phantom lines. Thus, rods 26 and 28 are movable between a sharpening position where they are received in holes 18 and 20, respectively, and a storage position wherein they are received in chambers 32 and 34, respectively.

Chambers 32 and 34 also each have an elongated rectangular aperture 40 which is formed on upper surface 16 and which allows a user to visually inspect whether rods 26 and 28 are in their respective chambers. Cover 42 is attached to body 12 by pivot arrangement 44, as best shown in FIGS. 1, 3, and 4. The cover is pivotable between an open position shown in FIG. 2 and a closed position shown in FIGS. 1, 3–5. In its open position, cover 42 is pivoted past a position that is perpendicular to body 12 so that flange portions 46 of the cover rest on abutting surfaces 48 formed on body 12, as best shown in FIG. 2.

In this open position, the cover forms an acute angle with the section 50 of body 12 located between the point of attachment of the cover and end 52 of body 12. Section 50 provides a portion of body 12 for the device user to grasp with one hand during the sharpening operation, as shown in FIG. 2. When the user grasps section 50 and cover 42 is in its open position, the cover generally shields and protects the grasping hand as the user utilizes his/her other hand to sharpen the blade, also as shown in FIG. 2. If the user becomes careless during his/her downward strokes and misses one of the rods, the cover provides some protection against the blade being sharpened contacting and lacerating the hand grasping the body.

In order to close cover 42, rods 26 and 28 must be removed from holes 18 and 20 and slid into their respective storage chambers. Cover 42 can then be pivoted to its closed position shown in FIGS. 1, 3, and 4. In its closed position, end 54 of cover 42 encloses openings 36 of chambers 32 and 34. Thus, the closing of the cover secures rods 26 and 28 within their respective chambers. In order to secure cover 42 in its closed position, protrusion 56 located on the cover engages groove 58 located on end 38 of body 12. Body 12 has tabs 60 and cover 42 has tab 62 to allow for easy opening of the cover from its closed position.

In order to convert sharpening device 10 from its storage configuration shown in FIG. 1 to its sharpening configuration shown in FIG. 2, a user first uses tabs 60 and 62 to unlock the cover from its closed position. With end 54 no longer blocking openings 36, body 12 is then tilted on end so that rods 26 and 28 will slide out of their respective storage chambers. Body 12 is then positioned so that lower surface 14 engages the support surface. Cover 42 is pivoted upwardly so that flange portions 46 engage abutting surfaces 48. In this opened position, rods 26 and 28 are positioned in their respective holes 18 and 20 to form the V-shaped sharpening pattern. The user then grasps section 50 with one hand to hold the device in place and utilizes his/her other hand to sharpen the blade.

Therefore, the present invention provides a knife sharpening device which is convertible between a storage configuration and a sharpening configuration. The storage configuration encloses and secures all of the component parts of the sharpening device within one uniformly shaped and easily storable body. A pivotal cover is used to secure the rods within storage chambers formed in the body. This pivotal cover, when in its open position, also serves as a hand guard to protect the hand of the user that holds the device on the support surface.

It should be emphasized that while the invention provides added safety features for a user in comparison with prior art sharpeners, considerable skill and care must still be utilized to protect against accidents. The device should not be utilized by small children under any circumstances.

Having thus described the invention, what is claimed is:

1. A blade sharpening device convertible between a sharpening configuration and a storage configuration, the device comprising:

a pair of elongated abrasive sharpening members;

an elongated body having a lower surface for resting on a support surface and an upper surface with a pair of receiving holes disposed thereon, each of said receiving holes receiving one of said sharpening members so that said sharpening members are supported in a V-shaped sharpening pattern when said device is in its sharpening configuration, said body also having a pair of elongated storage chambers extending along the longitudinal length of said body, each of said storage chambers having an opening disposed on one end of said body, each of said storage chambers receiving one of said sharpening members through its respective opening when the device is in its storage configuration; and a cover pivotally secured to said body at an intermediate location and having an open position corresponding to the sharpening configuration and a closed position corresponding to the storage configuration, said cover, when in its closed position, enclosing each of said openings of said chambers so that each of said sharpening members is secured in its respective storage chamber, said cover, when in its open position, allowing positioning of said sharpening members in said receiving holes to form said V-shaped sharpening pattern.

2. The sharpening device of claim 1 wherein said intermediate location at which said cover is secured generally divides said body into a first section from which said sharpening members extend in said V-shaped sharpening pattern and a second section which is grasped by one hand of a device user during a sharping operation, said cover, when in its open position, shielding the hand grasping said second section from possible accidental laceration from a blade being sharpened on said sharpening members.

3. The sharpening device of claim 2 wherein said cover in its open position forms an acute angle with said second section of said body.

4. The sharpening device of claim 2 wherein said first section of said body has a pair of elongated apertures formed on its top surface, each of said apertures corresponding to one of said chambers so that when said sharpening members are disposed in said chambers they are visible through said elongated apertures, each of said apertures being concealed by said cover when it is in its closed position.

* * * * *